United States Patent [19]

Jarvis

[11] Patent Number: 4,753,570

[45] Date of Patent: Jun. 28, 1988

[54] BIDIRECTIONAL PUMP WITH DIAPHRAGM OPERATED VALVE FOR DISHWASHER

[75] Inventor: Wilbur W. Jarvis, St. Joseph Township, Berrien County, Mich.

[73] Assignee: Whirlpool Corporation, Benton Harbor, Mich.

[21] Appl. No.: 918,709

[22] Filed: Oct. 14, 1986

[51] Int. Cl.[4] ..... F04D 29/50

[52] U.S. Cl. ..... 415/146; 415/26; 415/38; 137/510; 251/61.1

[58] Field of Search ..... 415/26, 27, 38, 146, 415/147, 148, 149 R, 149 A, 152 R, 152 A; 137/510; 251/61.1, 61.2

[56] References Cited

U.S. PATENT DOCUMENTS

| | | | |
|---|---|---|---|
| 2,838,002 | 6/1958 | Cohen | 415/146 |
| 2,864,312 | 12/1958 | Shelton et al. | 415/147 |
| 2,883,843 | 4/1959 | Bochan | 68/23.5 |
| 3,127,840 | 4/1964 | Bochan | 415/146 |
| 3,174,434 | 3/1965 | Schieve | 415/146 |
| 3,220,553 | 11/1965 | Growall et al. | 210/108 |
| 3,366,068 | 1/1968 | Rye | 415/146 |
| 3,411,532 | 11/1968 | Sully | 137/510 |
| 3,425,437 | 2/1969 | Knerr et al. | 137/119 |
| 3,426,964 | 2/1969 | Silvern | 415/146 |
| 3,595,520 | 7/1971 | Soberski | 251/61.2 |
| 3,633,622 | 1/1972 | Ralston | 137/625.44 |
| 3,851,993 | 12/1974 | Foster | 415/152 A |
| 3,861,642 | 1/1975 | Maddocks | 251/61.1 |
| 3,865,505 | 2/1975 | Flatland | 415/149 |
| 4,091,644 | 5/1978 | Bochan | 68/18 F |
| 4,467,627 | 8/1984 | Platt et al. | 415/152 A |
| 4,600,361 | 7/1986 | Bianco | 415/38 |

FOREIGN PATENT DOCUMENTS

| | | | |
|---|---|---|---|
| 121552 | 4/1948 | Switzerland | 415/149 |
| 794521 | 5/1958 | United Kingdom | 415/149 A |
| 891076 | 3/1962 | United Kingdom | 415/149 A |

*Primary Examiner*—Robert E. Garrett
*Assistant Examiner*—John T. Kwon
*Attorney, Agent, or Firm*—Wood, Dalton, Phillips, Mason & Rowe

[57] ABSTRACT

A bidirectional pump has a chamber in communication both with a drain conduit and a conduit for delivering washing liquid into a wash chamber. The drain conduit has a port communicating between the pump chamber and a drain outlet. An opening communicates between the delivery and drain conduits and is selectively sealed by a deformable diaphragm. With the pump rotating in a first direction and the liquid being delivered principally through the delivery conduit by the pump, a pressure differential is established across the diaphragm thereby urging a portion of the diaphragm sealingly against the port to prevent delivery of washing liquid through the drain conduit as during a rinsing cycle of the dishwasher. Reverse rotation of the pump reverses the pressure balance to urge the sealing portion of the diaphragm away from the drain port, thereby permitting flow through the drain conduit for suitable disposal of the used washing liquid.

15 Claims, 2 Drawing Sheets

FIG. 1
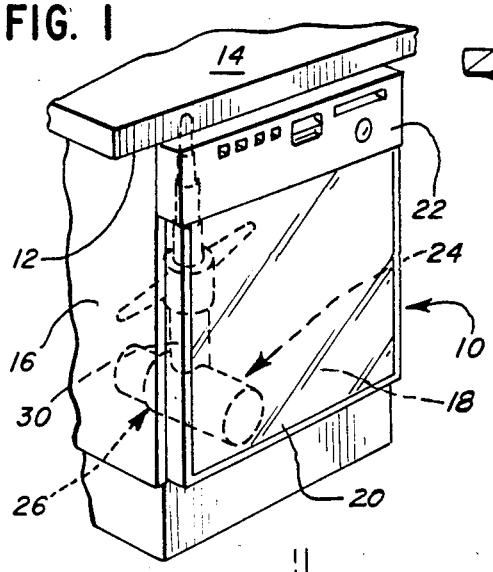
FIG. 5
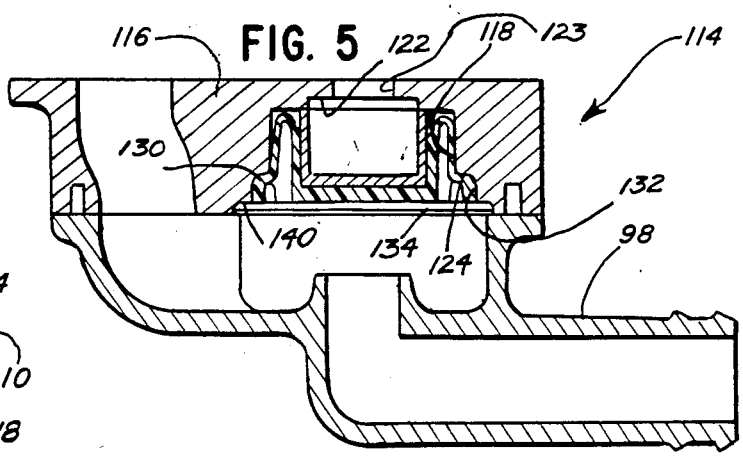
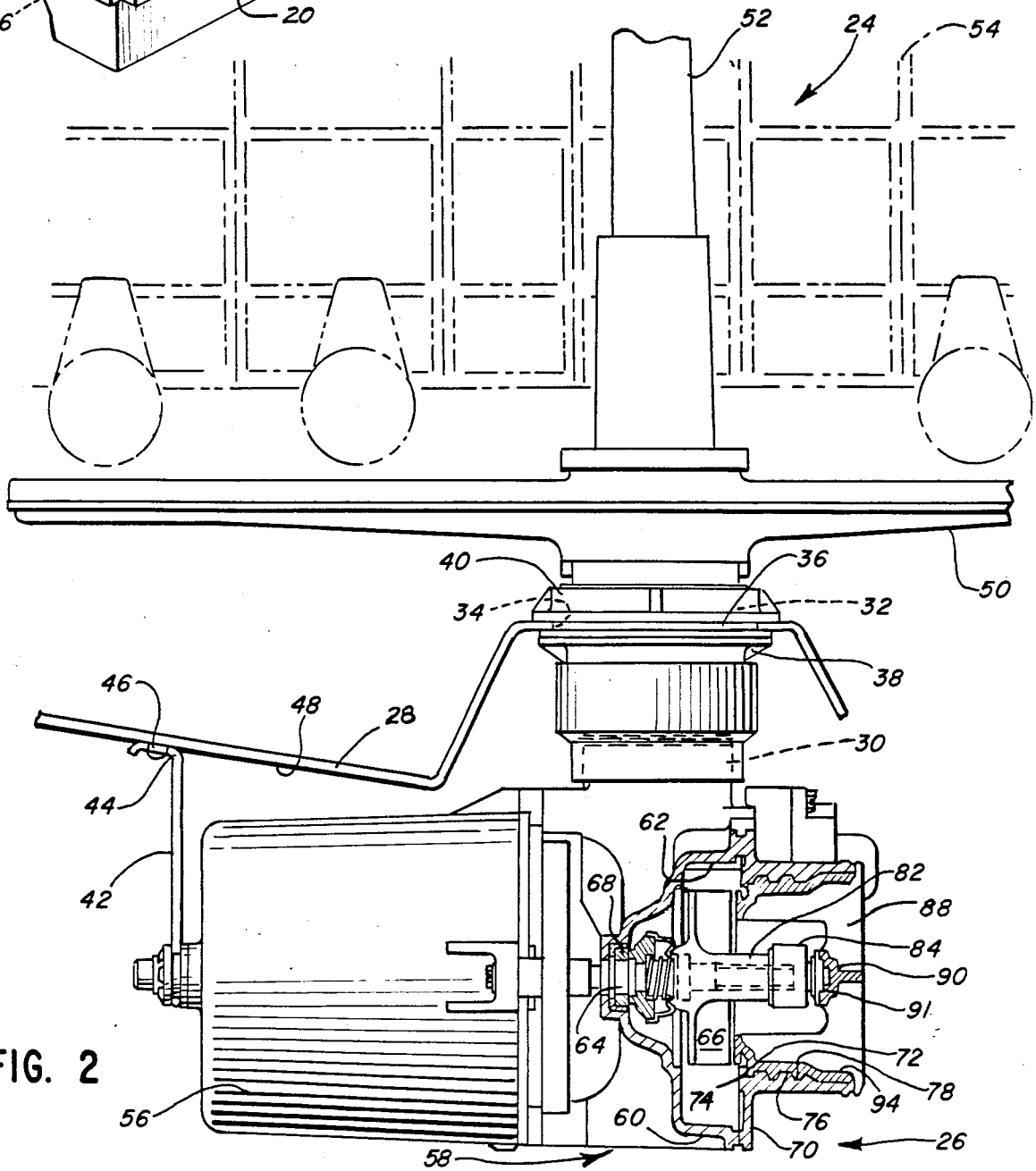
FIG. 2

FIG. 3
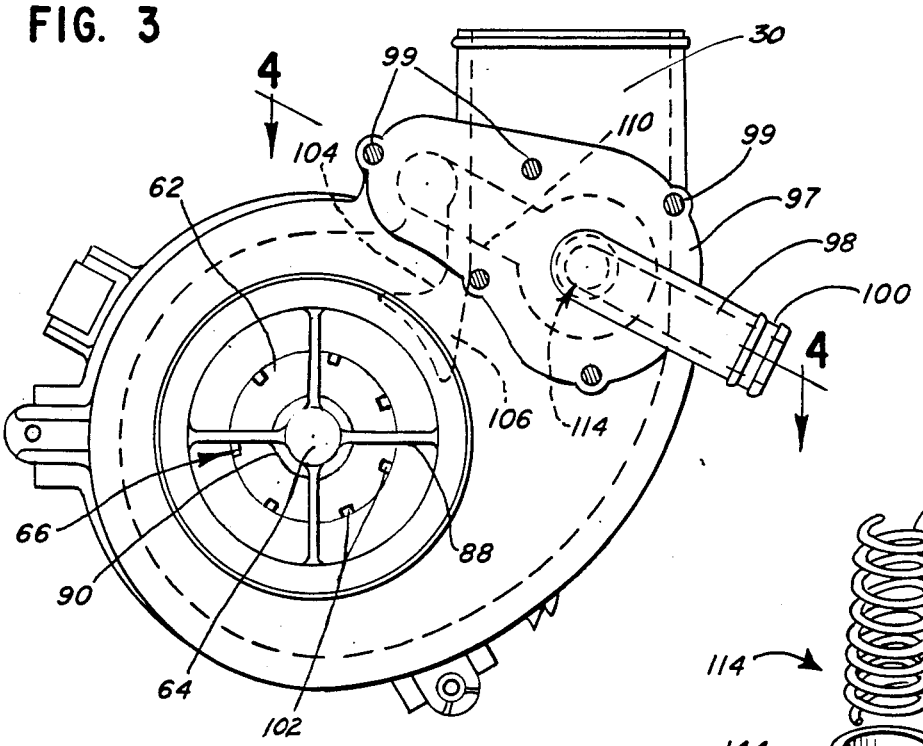
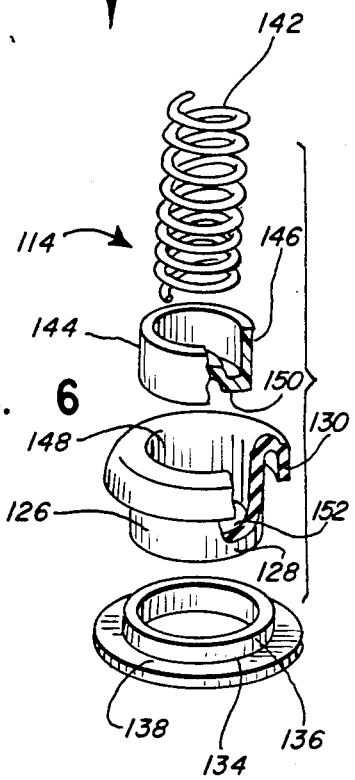
FIG. 6
FIG. 4
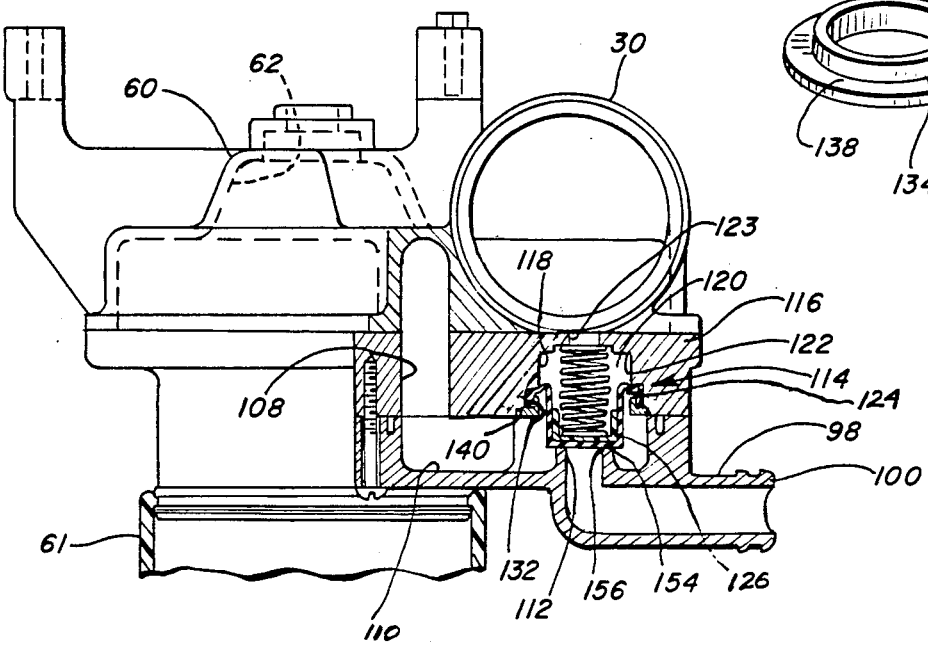

BIDIRECTIONAL PUMP WITH DIAPHRAGM OPERATED VALVE FOR DISHWASHER

BACKGROUND OF THE INVENTION

1. Field of the Invention

This invention relates to pumps for washing liquid in dishwashing apparatus and, more particularly, to structure for selectively controlling the delivery of washing liquid from said pump through separate conduits.

2. Description of the Prior Art

A complete operating cycle for conventional dishwashing apparatus includes at least one rinsing cycle wherein washing liquid is forcibly delivered into a wash chamber. The washing liquid is collected and recirculated until the rinsing cycle is completed after which the washing liquid is forcibly delivered into a suitable drain and directed away from the apparatus.

It is known to selectively propel washing liquid through conduits into the wash chamber and drain by separate, independently operable pumps. It is also known to use a bidirectional pump which, when operated in a first direction, directs washing liquid into the wash chamber and, when operated in a direction opposite to the first direction, discharges the washing liquid through the drain. Normally, the latter type structure requires valving to prevent inadvertent passage of washing liquid through one of the conduits when the flow is intended to be principally through the other conduit.

An exemplary structure is shown in U.S. Pat. No. 2,838,002, to Cohen. In Cohen, separate, deflectable, flap-like valves are anchored in the vicinity of each of the conduits. Rotation of the pump in one direction bends one valve over its associated outlet and urges the other valve away from a sealing position. Reversal of the pump rotation produces an opposite effect on the valves.

As an alternative to the Cohen structure, in U.S. Pat. No. 2,883,843, to Bochan, a single valve member is hinged for pivoting movement between two positions wherein transverse surfaces on the valve member sealingly close conduit openings. As with the Cohen structure, the valve is directly impacted by the liquid flow and is manipulated thereby.

The Cohen and Bochan structures have several drawbacks. First of all, the structures are relatively complicated. Further, for the valve elements to pivot freely, a hinge portion must be incorporated that can be easily deformed. Such structures are inherently susceptible to failure. Still further, the valve in each of Cohen and Bochan must pivot through a substantial range of motion. In the event that foreign matter accumulates in the path of the valves, the operation of the valves might be imparied and the seal at one or both of the conduits compromised.

It is also known to use solenoid valves to effect the aforementioned flow conversion. Alternatively, in U.S. Pat. No. 3,633,622, to Ralston, there is incorporated a bimetal control for a valve. The Ralston valve control as well as those incorporating solenoids, are relatively involved. This complicates manufacturing and increases the attendant costs thereof. Further, the more complicated the structure, the greater the likelihood of failure.

SUMMARY OF THE INVENTION

The present invention is specifically directed to overcoming the above enumerated problems in a novel and simple manner.

It is the principal objective of the present invention to afford a simple valve structure which senses and positively reacts to a pressure differential between two conduits through which liquid is selectively and forcibly delivered by a pump.

The pump has a chamber in communication both with a drain conduit and a conduit for delivering washing liquid into the wash chamber. The drain conduit has a port communicating between the pump chamber and a drain outlet. An opening communicates between the delivery and drain conduits and is sealed by a deformable diaphragm. With the pump rotating in a first direction and the liquid delivered principally through the delivery conduit by the pump, a pressure differential is established across the diaphragm, thereby urging a portion of the diaphragm sealingly against the port associated with the drain conduit. This prevents the escape of washing liquid through the drain as during the rinsing cycle for the dishwasher. Rotation of the pump oppositely to the first direction reverses the pressure balance and thereby urges the sealing portion of the diaphragm away from the drain port, thereby permitting full flow through the drain conduit for suitable disposal of the used washing liquid.

There is little tendency of foreign matter to accumulate on the diaphragm or associated sealing structure and therefore a positive seal is maintained. In a preferred form, the diaphragm can be simply seated and maintained in place by a snap-fit retaining ring.

BRIEF DESCRIPTION OF THE DRAWINGS

Other features and advantages of the invention will be apparent from the following description taken in conjunction with the accompanying drawings wherein:

FIG. 1 is a perspective view of a dishwasher having a liquid delivery pump embodying the invention;

FIG. 2 is a side elevation view of the system for delivering washing liquid into the wash chamber of the dishwasher of FIG. 1 and partially broken away to reveal valve structure according to the present invention;

FIG. 3 is a front elevation view of the pump in FIGS. 1 and 2;

FIG. 4 is a sectional view of the pump along line 4—4 of FIG. 3 with the valve structure situated for forcible delivery of washing liquid into the wash chamber;

FIG. 5 is a fragmentary, sectional view of the valve structure situated for drainage of washing liquid from the dishwasher; and FIG. 6 is an exploded, perspective view of a stopper assembly associated with the valve structure for the pump.

DESCRIPTION OF THE PREFERRED EMBODIMENT

A dishwasher suitable for incorporation of the present invention is shown generally at 10 in FIG. 1. The dishwasher 10 is a floor mounted, under the counter style and is dimensioned to fit closely beneath the underside 12 of a counter 14. The dishwasher 10 comprises a cabinet 16 defining an internal wash chamber 18 within which the dishes and utensils are supported by racks (not shown in FIG. 1). The wash chamber 18 is accessed through an opening at the front of the cabinet 16, which opening is selectively sealed by a hinged door 20. The door has an associated console 22 which contains the electrical control mechanism for the dishwasher.

The system for controlling delivery of washing liquid to and discharge thereof from the wash chamber 18 is shown generally at 24 in each of FIGS. 1 and 2. Generally, the system 24 comprises a pump at 26 supported beneath and from a tub 28 which defines the wash chamber 18. The pump 26 has a delivery conduit 30 with a portion 32 extending through an opening 34 in the tub 28. The bottom wall 36 of the tub 28 is maintained captive between an enlarged portion 38 of the conduit 30 and a retaining nut 40 threadably engaged with the upper portion 32 of the conduit. The pump is stabilized by a hanger bracket 42 having an offset leg 44 engaged with a clip 46 on the underside 48 of the tub.

During the rinsing cycle of the dishwasher, washing liquid from a supply is forcibly delivered by the pump 26 through the conduit 30 into a lower, rotary spray arm 50 and through a tower 52 into an upper spray outlet (not shown). The washing liquid is distributed by the spray arm and outlet over dishes and utensils supported in movable racks 54 and in some cases in racks associated with the door 20. The water delivered to the wash chamber is collected in a sump for return to the pump and is thereby recirculated. After the rinsing cycle, the washing liquid is drained from the dishwasher and directed as to a sewer or the like. The forced delivery of the washing liquid selectively to the wash chamber and drain is accomplished by the pump 26, which has a reversible motor 56 which is rotated in a direction depending upon the cycle.

More particularly, the pump motor 56 is connected as by bolts to a pump assembly at 58, integrally formed with the conduit 30. The pump assembly can be constructed independently of the motor 56 and joined therewith as a unit. The pump assembly, as detailed in FIGS. 2–5, has a housing 60 defining an impeller chamber 62. The chamber 62 is substantially cylindrical and concentric with a shaft 64, which is driven by the motor 56 and keyed to a bladed impeller 66. A seal 68 surrounds the shaft 64 and prevents leakage of liquid from the chamber 62 back towards the motor 56. The chamber 62 is bounded axially, remote from the motor, by a housing cover 70. The cover 70 is undercut to define an axially facing shoulder 72, which bears against a facing shoulder 74 on a cup-shaped cap 76, received in an internal bore 78 in the cover 70. The ca 76 is threadably received in the housing cover bore.

The impeller 66 has a hub 82 with a free end that has a metal hub 84 journalled for rotation therewith and maintained centrally of the cover bore 78 by motor shaft 64, which is keyed to hub 82. The cap 76 has a plurality of ribs 88 which support a hub 90 centrally of the bore 78. The hub 90 carries a thrust bearing element 91 against which metal hub 84 bears to take up the thrust loads generated by the hydraulic action of the rotating impeller 66. The inside annular surface 94 of the cup-shaped cap 76 defines an inlet conduit for communication of washing liquid from the sump to the impeller chamber 62 through a conduit 61 (FIG. 4).

As clearly seen in FIGS. 3 and 4, the impeller chamber 62 is in communication with the conduit 30 for delivery of washing liquid into the wash chamber. The impeller chamber is also in communication, through a drain housing 97, attached to housing 60 through bolts 99, with a drain conduit 98 which has an outlet 100 which can be suitably attached to a sewer or the like. As the impeller operates, a plurality of generally radially directed blades 102 thereon cause the washing liquid to be propelled centrifugally. In the case of clockwise rotation of the impeller in FIG. 3, the blades force the washing liquid to swirl in a clockwise direction and to impinge against a curved wall 104 on a baffle 106 defined by the housing 60. The liquid from the chamber 62 is diverted and flows axially with respect to the rotational axis of the motor along drain conduit portion 108, is diverted radially through conduit portion 110 in housing 97, passes through a port 112 and bends outwardly for discharge through the drain outlet 100. The baffle 106 diverts the flow of washing liquid and prevents seepage of liquid between the conduits 30, 98 as the impeller is operated.

Rotation of the impeller in a counterclockwise direction forcibly directs the liquid through the delivery conduit 30 and into the spray arm assemblies. With the motor operated in the counterclockwise direction for delivery of the liquid into the wash chamber, there is a tendency of liquid from the impeller chamber 62 to find its way into the drain conduit 98.

To prevent this, a stopper assembly at 114 in FIGS. 4–6 is incorporated. The stopper assembly 114 resides in a wall 116 seprating the delivery conduit 30 and drain conduit 98. The wall 116 has a bore 118 extending partially therethrough in an axial direction with respect to the impeller axis and defines a chamber 120 with a surface 122 facing axially towards the port 112. A reduced diameter bore defines an opening 123, which is in coaxial relationship with the bore 118 and so that the opening 123 and bore 118 define a communication passageway between the delivery conduit 30 and the chamber 120. The wall 116 is undercut to define an annular shoulder 124 also facing the port 112.

The stopper assembly 114 comprises a cup-shaped diaphragm 126 with a cylindrical body 128 having a doubled back lip 130. The diaphragm is preferably made of a resilient material such as rubber. The lip 130 has a large enough diameter so that the diaphragm can cover the chamber opening 132 adjacent the drain conduit 98 and be pressed against the annular shoulder 124 so that the cup-shaped portion of the diaphragm body 128 opens towards the surface 122. To retain the diaphragm in place on the wall, a retaining ring 134 is provided and has a cylindrical body 136 and a peripheral annular flange 138. The ring 134 is dimensioned to snap-fit to the wall at the chamber opening 132 and compressibly retains the lip 130 of the diaphragm captive against the shoulder 124 on the wall 116. The wall has an annular undercut 140 to accept the flange 138 so that the ring 134 does not project into the conduit 98 and impede liquid flow.

The diaphragm is normally biased to the position shown in FIG. 4 in which flow is principally through the delivery conduit 30. The biasing is accomplished by a coil spring 142 which bears between the chamber surface 122 and a cup-shaped forming member 144. The forming member 144 has an outer cylindrical surface 146 seating closely against the inside surface 148 of the diaphragm and a flat bottom surface 150 that facially abuts the surface 152 on a wall 154 at the closed end of the body of the diaphragm.

In operation, with the impeller rotating in a counterclockwise direction in FIG. 3, the flow is directed principally through the delivery conduit 30. The fluid flows through the opening 123 into the chamber 120 and builds pressure against the forming member 144. A pressure differential is established on opposite sides of the diaphragm wall 154 so that the diaphragm is urged towards the port 112. The bottom surface 150 of the forming member presses the diaphragm wall 154 sealingly against an annular edge 156 about the port 112 facing toward the conduit 30. With the diaphragm in this position, liquid flow through the drain conduit 98 is substantially eliminated.

Upon reversing the direction of rotation of the impeller, a greater pressure is established in the drain conduit 98 than the delivery conduit 30. This pressure differential results in the diaphragm being urged against the force of spring 142 to the position shown in FIG. 5. In this position, the body 128 of the diaphragm is substantially collapsed into the chamber so that an unobstructed flow path is defined through the drain conduit 98.

It can be seen that assembly of the stopper assembly 114 involves merely placing the spring 142, forming member 144 and diaphragm 126 in sequence in the chamber 120 after which the retaining ring 134 can be snap-fit into place. The diaphragm positively reacts to a pressure differential across the wall 153 thereof, as dictated by the direction of rotation of the impeller to control the flow of liquid from the pump.

The foregoing disclosure of specific embodiments is intended to be illustrative of the broad concepts comprehended by the invention.

I claim:

1. a liquid control structure for controlling delivery of liquid from a supply selectively to either of first and second points of use, said structure comprising:

a first conduit having a first outlet adapted to be disposed in communication with a first point of use;

a second conduit having a second outlet adapted to be disposed in communication with a second point of use;

means for delivering liquid selectively to either of said first and second conduits, said second conduit having an associated port through which liquid from the delivering means flows in moving toward said second point of use and a flat sealing edge around the port;

stopper means responsive to a differential in the pressure of liquid respectively in the first and second conduits to be disposed (a) in a first position for preventing delivery of liquid through the second conduit to said second outlet and (b) in a second position for permitting delivery of liquid through the second conduit to said second outlet, said stopper means comprising a collapsible diaphragm having a wall with substantially flat, oppositely facing surfaces with one of said oppositely facing surfaces directly exposed to liquid directed by the liquid delivering means through the first conduit and the other of said oppositely facing surfaces directly exposed to liquid directed by the liquid delivering means through the second conduit and urged sealingly against the edge around the second conduit port with the stopper means in its first position, said diaphragm in said first position being extended and in said second position being collapsed;

a rigid forming member with a flat surface;

means mounting the forming member to the diaphragm so that the flat surface of the forming member is facially engaged with the one of the oppositely facing surfaces on the wall of the diaphragm; and means normally biasing the flat surface of the forming member against the diaphragm wall and in turn the other of the oppositely facing diaphragm wall surfaces sealingly against the edge around the second conduit port toward the first position of said stopper means, whereby with the liquid pressure in the first conduit in conjunction with the biasing means develops a force on the one of the oppositely facing wall surfaces to urge the diahragm into said first, extended position, and with the liquid pressure in the second conduit a predetermined amount greater than the liquid pressure in the first conduit the liquid in the second conduit develops a force on the other of the oppositely facing wall surfaces to overcome the force developed by the biasing means and urge the diaphragm into said second, collapsed position.

2. The liquid control structure according to claim 1 wherein said second conduit has an associated port with an annular edge thereabout, said diaphragm has an associated sealing portion which, with the pressure in the first conduit greater than the pressure in the second conduit sealingly bears against the annular port edge to block liquid flow through said second outlet of the second conduit.

3. The liquid control structure of claim 1 wherein the liquid delivering means comprises a bidirectional pump and operation of the pump in a first rotational direction moves liquid from the supply principally through said first conduit, and rotation of the pump in a rotational direction opposite to said first direction moves liquid from the supply principally through said second conduit.

4. The liquid control structure of claim 1 including a wall with an opening providing communication between said first and second conduits, a lip on said diaphragm and snap-fit means for removably holding the diaphragm lip against the wall with the opening providing communication between the first and second conduit.

5. The bidirectional pump according to claim 4 wherein said snap-fit means comprises ring means surrounding a portion of the diaphragm to compressibly and captively maintain the diaphragm lip against the wall with the opening providing communication between the first and second conduits.

6. The bidirectional pump according to claim 1 wherein one of said oppositely facing surfaces faces the first conduit and the one oppositely facing surface is collapsed toward the first conduit as the stopper means moves from the first position to the second position.

7. The liquid control structure of claim 1 wherein said forming member comprises a rigid cup-shaped member.

8. The liquid control structure of claim 1 wherein said diaphragm includes a cup-shaped portion and said forming member comprises a rigid cup-shaped member fitted into said cup-shaped portion of the diaphragm.

9. The liquid control structure of claim 1 wherein said diaphragm includes a cup-shaped portion and said forming member comprises a rigid cup-shaped member fitted into and frictionally retained by said cup-shaped portion of the diaphragm.

10. A bidirectional pump for delivering washing liquid into a wash chamber of a dishwashing apparatus, said pump comprising:

a housing defining an impeller chamber;

means for introducing liquid from a supply into said impeller chamber;

an impeller in said impeller chamber;

a liquid delivery conduit communicating between the impeller chamber and the wash chamber;

a drain conduit communicating between the impeller chamber and a drain outlet;

means for selectively rotating the impeller in opposite directions, said impeller directing liquid in said impeller chamber principally into the delivery conduit when rotated in a first direction and directing liquid in said impeller chamber principally into the drain conduit when rotated oppositely to the first direction;

means for sensing a pressure differential between the delivery and drain conduits and movable (a) to a first position to prevent flow of liquid through the drain conduit to the drain outlet and (b) to a second position wherein liquid can flow through the drain conduit to the drain outlet, said sensing means comprising a collapsible cup-shaped diaphragm with an annular body and a bottom wall having one surface thereon exposed to liquid in the liquid delivery conduit and an oppositely facing surface thereon exposed to liquid in the drain conduit, said diaphragm collapsing with the liquid pressure on the oppositely facing bottom wall surface greater than the pressure on the one bottom wall surface;

a rigid forming member with a flat surface;

means mounting the forming member to the diaphragm so that the flat surface of the forming member is facially engaged with the one of the oppositely facing surfaces on the wall of the diaphragm; and biasing means for urging said forming member against said diaphragm bottom wall, whereby with the liquid pressure in the first conduit in conjunction with the biasing means develops a force on the one of the oppositely facing wall surfaces to urge the diaphragm into said first, extended position, and with the liquid pressure in the second conduit a predetermined amount greater than the liquid pressure in the first conduit the liquid in the second conduit develops a force on the other of the oppositely facing wall surfaces to overcome the force developed by the biasing means and urge the diaphragm into said second, collapsed position.

11. The bidirectional pump of claim 10 wherein there is a communication passageway between the drain and delivery conduits and means mount the diaphragm in the communication passageway.

12. The bidirectional pump of claim 10 wherein there is a port with an annular edge thereabout between the impeller chamber and the drain outlet, there is a communication passageway between the drain and delivery conduits, and means mount the diaphragm so that the oppositely facing surface of the diaphragm bottom wall moves sealingly against the annular edge on the port between the impeller chamber and drain outlet with the pressure in the delivery conduit greater than the pressure in the drain outlet.

13. The bidirectional pump of claim 12 wherein said rigid member comprises a substantially rigid cup-shaped forming member.

14. The bidirectional pump of claim 10 wherein means normally bias the diaphragm to its first position.

15. The bidirectional pump of claim 10 wherein there is a wall between the delivery and drain conduits, a retaining ring is provided and means are provided for removably press fitting said retaining ring to the wall between the delivery and drain conduits so that the diaphragm is held captive between the retaining ring and the wall.

* * * * *